US006557654B1

(12) United States Patent
Murray

(10) Patent No.: US 6,557,654 B1
(45) Date of Patent: May 6, 2003

(54) DRILL PIPE HAVING A JOURNAL FORMED THEREON

(75) Inventor: Geoffrey Neil Murray, Willis, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/581,807

(22) PCT Filed: Jan. 5, 1999

(86) PCT No.: PCT/NZ99/00001

§ 371 (c)(1),
(2), (4) Date: Oct. 2, 2000

(87) PCT Pub. No.: WO99/35366

PCT Pub. Date: Jul. 15, 1999

(30) Foreign Application Priority Data

Jan. 5, 1998 (NZ) ..... 329536

(51) Int. Cl.[7] ..... E21B 17/10
(52) U.S. Cl. ..... 175/325.3; 175/262
(58) Field of Search ..... 175/325.1, 325.3, 175/325.5, 322, 262; 138/145, 177

(56) References Cited

U.S. PATENT DOCUMENTS

| | | | | | |
|---|---|---|---|---|---|
| 2,318,263 | A | | 5/1943 | Smith, Jr. | 219/10 |
| 3,982,594 | A | * | 9/1976 | Berthiaume | 175/337 |
| 4,043,611 | A | | 8/1977 | Wallace | 175/325.1 |
| 4,102,552 | A | * | 7/1978 | Kellner | 175/325.3 |
| 4,368,021 | A | * | 1/1983 | Ryckman | 425/265 |
| 4,414,247 | A | | 11/1983 | Hubecker et al. | 427/230 |
| 4,436,118 | A | * | 3/1984 | Garrett | 138/110 |
| 4,436,158 | A | * | 3/1984 | Carstensen | 166/377 |
| 4,641,976 | A | * | 2/1987 | Kar | 384/95 |
| 4,665,996 | A | | 5/1987 | Foroulis et al. | 175/61 |
| 5,010,225 | A | | 4/1991 | Carlin | 219/76.12 |
| 5,803,193 | A | * | 9/1998 | Krueger et al. | 175/325.1 |
| 5,810,100 | A | | 9/1998 | Samford | 175/325.3 |
| 5,980,807 | A | * | 11/1999 | Weaver | 264/280 |

FOREIGN PATENT DOCUMENTS

| | | | |
|---|---|---|---|
| DE | 1568 34 | 12/1981 | |
| GB | 2 164 358 A | 3/1986 | |
| WO | 96/34173 | 10/1996 | ..... E21B/17/10 |
| WO | WO 97/08423 | 3/1997 | |

* cited by examiner

*Primary Examiner*—David Bagnell
*Assistant Examiner*—Zakiya Walker
(74) *Attorney, Agent, or Firm*—Moser, Patterson & Sheridan, L.L.P.

(57) ABSTRACT

A drill pipe (1; 12) has a journal (2; 15) formed thereon. Integrally formed stop collars (10, 11; 16, 17) are provided at each end of the journal (2; 15). The arrangement enables rotatable tools (18) to be fitted directly to a journal (2; 15) to reduce friction between the rotatable tool (18) and the journal (2; 15). The journal (2; 15) may be of a substantially greater length than the length of the rotatable tool (18) to facilitate lubrication and cooling. Alternatively removable stop collars (30; 31) are secured adjacent the ends of a journal (28) formed on the drill pipe (25). Methods of forming the journal surface (2; 15) during manufacture of a drill pipe are disclosed. There are also disclosed methods for reconditioning an existing drill pipe (20) to form a journal (21) thereon.

30 Claims, 4 Drawing Sheets

DRILL PIPE HAVING A JOURNAL FORMED THEREON

TECHNICAL FIELD

The present invention relates to a drill pipe, a method of forming drill pipe and drill pipe formed thereby as well as to a method of reconditioning drill pipe formed by conventional methods.

BACKGROUND TO THE INVENTION

Some currently available torque and drag reducing tools used in drilling applications installed directly onto drill pipes. Such tools may rotate about the drill pipe to reduce rotational torque. As the outer surface of standard drill pipe is neither perfectly round nor smooth, such tools have compromised torque reduction performance. Additionally, the fluid film operational principle of such tools sees drilling fluid, containing abrasive drill cuttings, passing between the tool and the drill pipe. This creates wear on the drill pipe and may compromise the strength of the drill pipe, particularly as the wear patterns can be deep circumferential grooves which may act as stress raisers in the tubular wall.

DISCLOSURE OF THE INVENTION

The object of the present invention is to provide a drill pipe having an integrally formed journal area having improved hardness, roundness and smoothness and methods of forming a journal on a drill pipe, or to at least provide the public with a useful choice.

According to a first aspect of the invention there is provided a drill pipe having coupling sections at either end thereof:

a pair of stop collars integrally formed with the drill pipe and extending radially outward; and wherein a hardfacing material has been applied to the outer surface of the drill pipe between the stop collars to form a journal for supporting a rotating tool.

According to a further aspect of the invention there is provided a set of drill pipes as hereinbefore described wherein the stop collars of the drill pipes are located at different positions along the drill pipes to facilitate efficient stacking of the drill pipes.

According to a further aspect of the invention there is provided a combination comprising a drill pipe as hereinbefore described and a drilling tool. The length of the journal is sufficiently longer than the length of the drilling tool to facilitate lubrication and cooling of the interface between the journal and the tool to reduce friction therebetween.

According to another aspect of the invention there is provided a method of forming a journal on a drill pipe during manufacture comprising the steps of:

i/ applying a hardfacing material to a section of the drill pipe between a pair of intregally formed stop collars prior to heat treating the drill pipe, ii/ heat treating the drill pipe; and iii/ precision grinding the section to which the hardfacing material has been applied to form a smooth journal surface on the drill pipe.

The hardfacing is preferably an amorphous type hardfacing. The hardfacing may be applied by high velocity oxy fuel, plasma spray, combustion powder, combustion wire, arc wire spraying, flame thermal spray, nitriding, carburising or other case hardening techniques. Alternatively, the hardfacing may be a ceramic material or PDC (polycrystalline diamond compact).

According to another aspect of the invention there is provided a method of forming a journal on a section of preformed drill pipe comprising:

i/ lightly machining a section of the drill pipe between a pair of intregally formed stop collars;

ii/ applying a hardfacing material to the section of the drill pipe; and iii/ grinding the hardfaced section so that it is round and smooth.

The hardfacing material is preferably applied by spluttering, for example by twin arc or high velocity oxy fuel spraying the hardfacing material directly onto the existing drill pipe. The hardfacing material is preferably ARMOR-COR M or ARNCO with options being Rolls Wood or other suitable materials.

There is further provided a drill pipe having coupling sections at either end thereof and a journal formed on the drill pipe between said coupling sections, the ovality of the journal being less than or equal to 0.7 mm.

BRIEF DESCRIPTION OF THE DRAWINGS

The invention will now be described with reference to the accompanying drawings in which.

BEST MODE FOR CARRYING OUT THE INVENTION

Figure 1A:
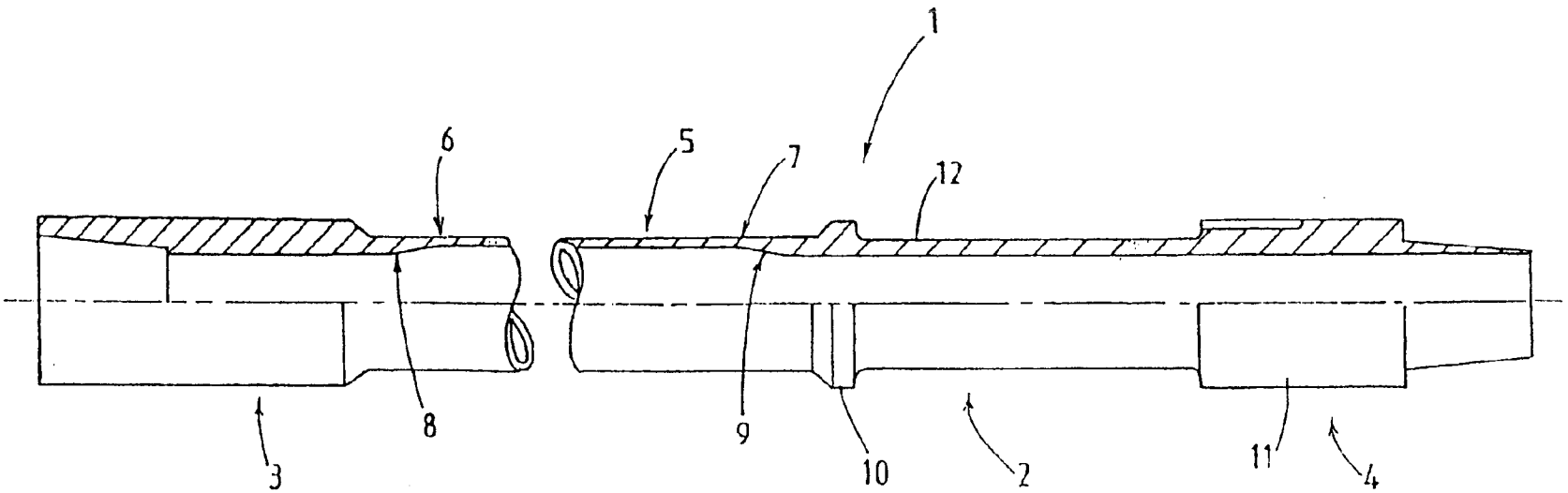
FIG. 1*a*: shows a partial sectional side view of drill pipe with an integrally formed journal surface.

Referring to FIG. 1*a* there is shown a drill pipe 1 having an integrally formed journal generally indicated by the numeral 2. The drill string has a female coupling section 3 at one end, a mate coupling section 4 at the other end and a pipe section 5 therebetween.

Female coupling 3 and male coupling 4 are preferably formed by forging and are friction welded to respective ends of pipe section 5 at areas 6 and 7. The thickness of the drill pipe is seen to vary gradually from female coupling 3 and male coupling 4 to pipe section 5 at points 8 and 9. This gradual tapering avoids the creation of a stress point at a rapid transition.

Integrally formed collars 10 and 11 define a journal surface 12 therebetween. The pipe string is formed substantially in accordance with standard procedures apart from the procedures for forming journal 2. Female portion 3 and male portion 4 (including journal 2) are formed by forging and are friction welded to pipe section 5. Male fitting 4 is forged in a shape including collars 10 and 11 and journal surface 12.

Prior to heat treating the drill pipe in a standard forming procedure an amorphous type hardfacing material is applied to journal surface 12. The hardfacing surface may be formed on journal surface 12 using case hardening techniques, such as nitriding or carburising. Alternatively high velocity oxy fuel, plasma spray, combustion powder, combustion wire, arc wire spraying, or flame thermal spray techniques may be used. Alternatively, a ceramic layer or a PDC (polycrystalline diamond compact) layer may be applied.

The drill pipe is then heat treated in the normal manner. The journal surface 12 of the drill pipe so formed is then precision ground to form a smooth round journal surface upon which a tool may be fitted. As collars 10 and 11 are integrally formed during manufacture of the drill pipe 1 no additional collars need to be provided. Due to the smoothness of journal 12 the problems associated with fitting tools directly to drill pipes encountered in the prior art may be substantially overcome.

Figure 1B:
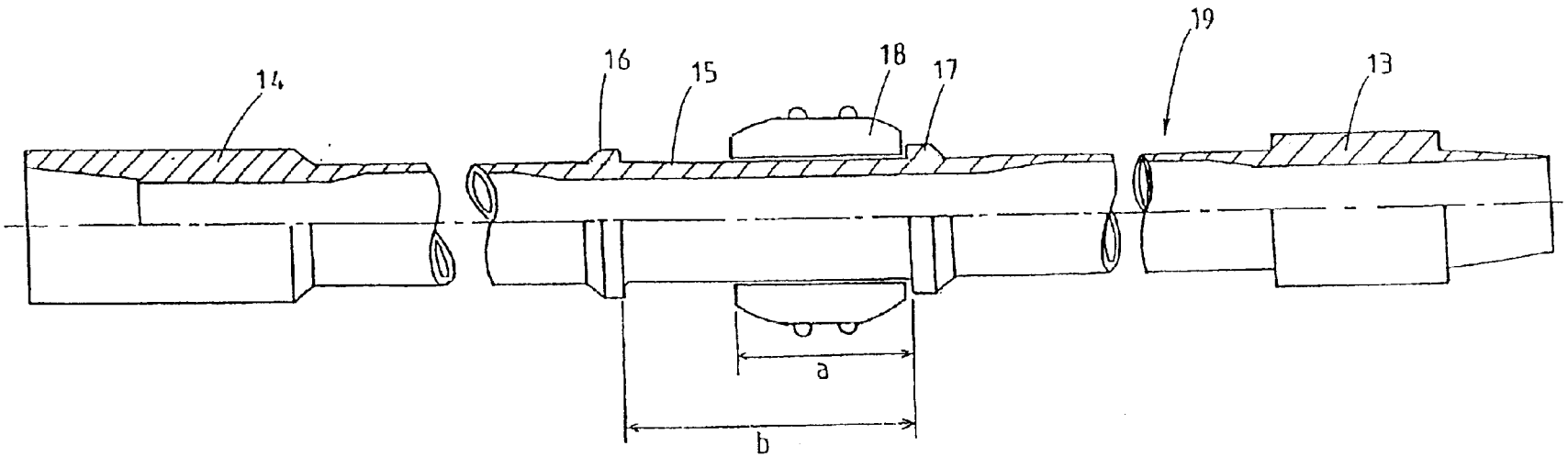
FIG. 1*b*: shows a partial sectional side view of a drill pipe with a drilling tool secured thereto.

Referring now to FIG. 1*b* there is shown a drill pipe 19 having male and female coupling sections 13 and 14 at either end thereof. Journal 15 is located at a central region of the drill pipe 19 and stop collars 16 and 17 are integrally formed with drill pipe 19 at either end of journal 15. A rotatable drilling tool 18 is secured about journal 15. A rotatable drilling tool 18 may be a multi-part drilling tool as described in WO 96/34173, or similar, which is able to be secured about journal 15 in use.

The length b of journal 15 is preferably sufficiently greater than the length a of rotatable drilling tool 18 to allow effective lubrication and cooling of the interface between journal 15 and rotatable drilling tool 18. Length b is preferably at least 20% greater than length a, preferably length b is more than 35% greater than length a, more preferably length b is more than 50% greater than length a. By allowing the rotatable drilling tool 18 to move along journal 15 lubricant may be introduced to the interface between journal 15 and rotatable drilling tool 18 as well as allowing heat to dissipate from journal 15, thus reducing wear.

In the embodiment shown in FIG. 1*b* collars 16 and 17 are provided at a central location along drill pipe 19. In the embodiment of FIG. 1*a* the stop collar 10 and stop collar formed by male coupling section 11 were provided at one end of the drill pipe 1. By providing a set of drill pipes having the collars located at different positions along the drill pipes the drill pipes may nestle together when stacked to achieve more efficient stacking.

Figure 1C:
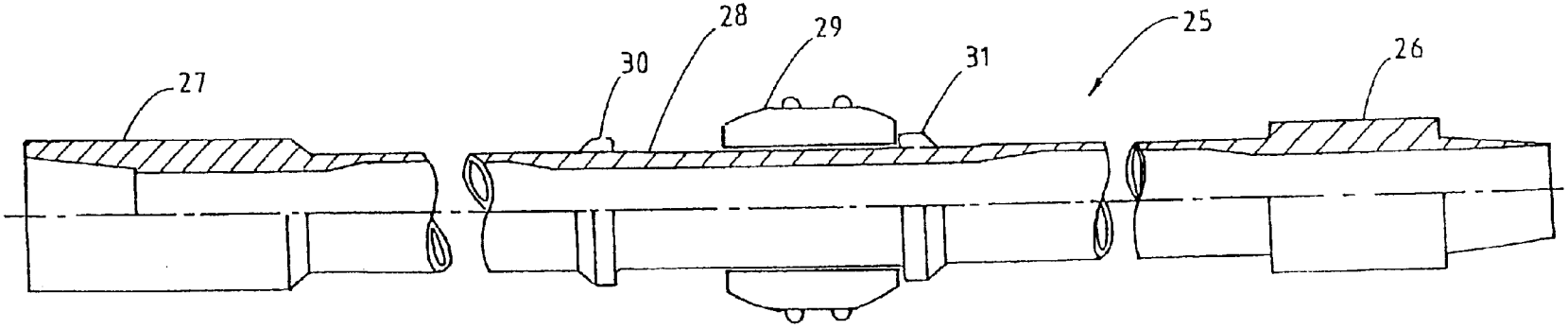
FIG. 1*c*: shows a partial sectional side view of a drill pipe having separate stop collars fitted thereto.

Referring now to FIG. 1*c* there is shown a drill pipe 25 having male and female coupling sections 26 and 27 at either end thereof. Journal 28 is formed on drill pipe 25 and a rotatable tool 29 is mounted upon journal 28. In this case moveable stop collars 30 and 31 are secured at either end of journal 28. Stop collars 30 and 31 may be of two part construction so that they can be secured to drill pipe 25 in use. This arrangement allows the spacing between the stop collars to be varied depending upon the tool secured to the drill pipe. It also simplifies the manufacture of drill pipe as the stop collars do not need to be integrally formed, particularly for central areas of the drill pipe. This approach is also applicable where a journal is to be formed upon an existing section of drill string.

The journals of the drill pipes described in FIGS. 1*a* to 1*c* should be round, hard and smooth to minimise wear of the journal surface and rotatable tool. The surface of the tool should have a roughness of less than 0.8 micrometers. The journal should have an ovality of less than or equal to 0.7 mm, preferably less than 0.5 mm and more preferably less than 0.25 mm. The journal should also have a surface hardness of greater than or equal to 35 Rc, preferably greater than 38 Rc. The length of the journal will typically be less than 3 meters. Methods of forming the journals will be described in conjunction with FIGS. 2 to 5 below.

When machining or treating preformed drill pipes care must be taken not to heat the drill pipe in such a manner that it loses its temper. Referring now to FIGS. 2 to 5 a method of reconditioning a drill pipe is shown schematically.

Figure 2:
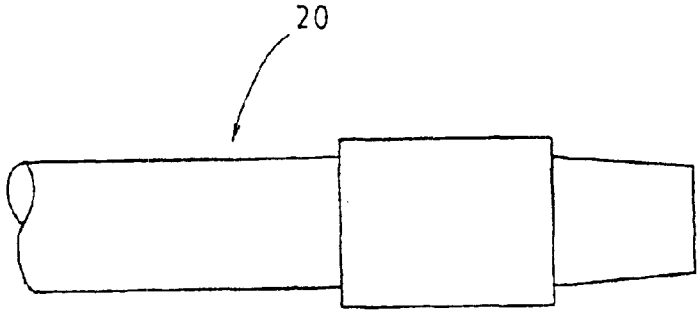
FIG. 2: shows a section of conventional drill pipe.
Figure 3:
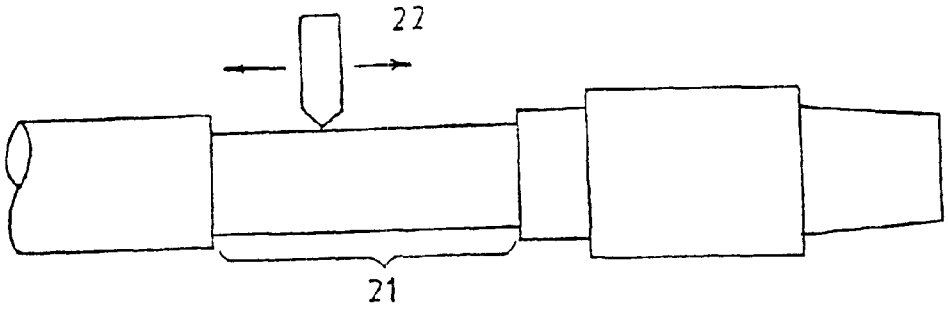
FIG. 3: shows the drill pipe of FIG. 2 after machining.

In FIG. 2 a drill pipe 20 is shown prior to reconditioning. In the first step shown in FIG. 3 a section 21 of the drill pipe is lightly machined, preferably by rotating the drill pipe in a lathe relative to bit 22 which moves along the section 21. The extent of machining has been greatly exaggerated for illustrative purposes.

Figure 4:
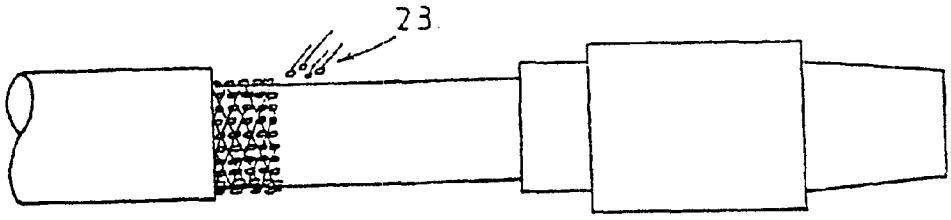
FIG. 4: shows the application of a hardfacing material to the drill pipe shown in FIG. 3.

In the next step shown in FIG. 4 a hardfacing material is applied. The procedure used to form the hardfacing must not heat the drill pipe 20 in such a manner as to affect its temper. One method is to apply material by spluttering, preferably by twin arc or high velocity oxy fuel spraying hardfacing material 23 directly onto section 21 of the drill pipe. This technique requires careful preheating of the drill pipe to a temperature which is not so hot as to affect the temper of the pipe but not so cold that the hardfacing will not be successfully applied. The hardfacing material 23 is deposited using a finely calibrated arc transfer pressure. A back-step application technique may be required to ensure that the base material temperature remains within acceptable limits.

Preferred hardfacing materials are ARMORCOR M or ARNCO. It will, however, be appreciated that other suitable techniques or materials may be employed as long as the above requirements are met.

Figure 5:
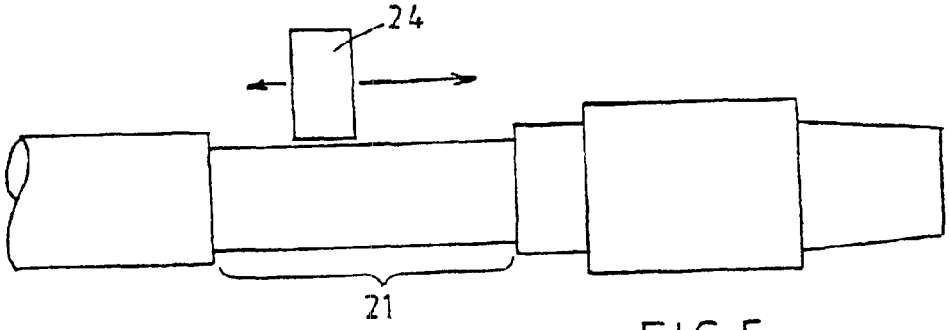
FIG. 5: shows the drill pipe of FIG. 4 after grinding.

In the final step, shown in FIG. 5, the hardfaced section 21 is ground by aluminium oxide grinder 24 so that the journal surface 21 is round and smooth. A drilling tool may then be installed onto the drill pipe in the normal way. If required, collars may be provided at either end of journal section 21.

The invention thus provides an improved drill pipe including an integrally formed journal which enables rotatable tools to be directly mounted to the journal surface resulting in decreased friction between the tool and the drill pipe and minimising wear on the drill pipe.

There is also provided a method of reconditioning existing drill pipe to provide a journal for receiving a tool which results in reduced friction between the tool and the drill pipe and minimises wear on the drill.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope of the present invention as defined in the claims.

What is claimed is:

1. A drill pipe having coupling sections at either end thereof and a journal formed on the drill pipe between said coupling sections, wherein the journal has a surface hardness of greater than or equal to 35 Rc.

2. A drill pipe as claimed in claim 1 wherein the journal has an ovality that is less than 0.5 mm.

3. A drill pipe as claimed in claim 1 wherein the journal has an ovality that is less than 0.25 mm.

4. A drill pipe as claimed in claim 1, wherein stop collars are integrally formed with the drill pipe.

5. A drill pipe as claimed in claim 1, wherein the journal has a surface hardness of greater than or equal to 38 Rc.

6. A drill pipe having coupling sections at either end thereof and a journal formed on the drill pipe between said coupling sections, wherein the journal has an ovality that is less than or equal to 0.7 mm, and wherein the surface of the journal has a roughness of less than 0.8 micrometers.

7. A drill pipe having coupling sections at either end thereof and a journal formed on the drill pipe between said coupling sections, wherein the journal has an ovality that is less than or equal to 0.7 mm, and wherein the journal has a surface hardness of greater than or equal to 35 Rc.

8. A drill pipe comprising:

coupling sections at either end thereof;

a journal formed on the drill pipe between said coupling sections, the journal having an ovality that is less than or equal to 0.7 mm; and removable stop collars positioned adjacent each end of the journal on the drill pipe.

9. A drill pipe having:

coupling sections at either end thereof;

a pair of stop collars integrally formed with the drill pipe and extending radially outward; and wherein a surface of the pipe between the stop collars has a roughness of less than 0.8 micrometers to form a journal for supporting a rotating tool.

10. A drill pipe comprising:

coupling sections at either end thereof;

a pair of stop collars integrally formed with the drill pipe and extending radially outward;

a journal formed on the drill pipe between the stop collars, wherein the journal is configured to receive a drilling tool of a given length disposed therearound such that an interface is created between the journal and the drilling tool; and wherein the spacing between the pair of stop collars is greater than the length of the drilling tool by an amount sufficient to promote lubrication and cooling of the interface between the tool and the drill pipe.

11. A drill pipe having a first end and a second end, and an outer surface between the first end and the second end, the drill pipe comprising:

a first coupling at the first end, the first coupling having an enlarged diameter portion;

a second coupling at the second end;

a pair of stop collars disposed on the drill pipe, the stop collars extending radially outward to define an enlarged diameter on the outer surface of the drill pipe; and wherein a hardfacing material has been applied to the outer surface of the drill pipe between the stop collars to form a journal for supporting a rotating tool.

12. A drill pipe as claimed in claim 11, wherein the pair of stop collars is integrally formed with the drill pipe.

13. A drill pipe as claimed in claim wherein 12, the journal has an ovality that is less than or equal to 0.5 mm.

14. A drill pipe as claimed in claim 12, wherein the journal has an ovality that is less than or equal to 0.25 mm.

15. A drill pipe as claimed in claim 12, wherein the journal has a surface hardness of greater than or equal to 38 Rc.

16. A drill pipe as claimed in claim 12, wherein the journal is located in a central region of the drill pipe between the first and second couplings.

17. A drill pipe as claimed in claim 12, wherein the surface of the journal has a roughness of less than 0.8 micrometers.

18. A drill pipe as claimed in claim 12, wherein the journal has an ovality that is less than or equal to 0.7 mm.

19. A drill pipe as claimed in claim 12, wherein the length of the journal is less than approximately 3 meters.

20. A drill pipe as claimed in claim 12, wherein the journal has a surface hardness of greater than or equal to 35 Rc.

21. A drill pipe as claimed in claim 12, wherein:

the journal receives a drilling tool disposed therearound such that an interface is created between the journal and the drilling tool; and the pair of stop collars are positioned so that for a drilling tool of a given length, the spacing between the pair of stop collars is greater than the length of the drilling tool by an amount sufficient to promote lubrication and cooling of the interface between the tool and the drill pipe.

22. A drill pipe as claimed in claim 21, wherein the spacing between the stop collars is at least 20% greater than the length of the drilling tool.

23. A drill pipe as claimed in claim 21 wherein the spacing between the stop collars is at least 50% greater than the length of the tool.

24. A drill pipe as claimed in claim 21, wherein the spacing between the pair of stop collars is at least 35% greater than the length of the drilling tool.

25. A combination comprising a drill pipe as claimed in claim 12, and a drilling tool wherein the tool is securable about the journal of the drill pipe so that the journal is at least partially located within a bore in the drilling tool.

26. A combination as claimed in claim 25 wherein the spacing between the stop collars is at least 20% greater than the length of the tool.

27. A combination as claimed in claim 25 wherein the spacing between the stop collars is at least 35% greater than the length of the tool.

28. A combination as claimed in claim 25 wherein the spacing between the stop collars is at least 50% greater than the length of the tool.

29. A set of drill pipes as claimed in claim 12, wherein the stop collars of the drill pipes are located at different axial positions along the drill pipes to facilitate efficient stacking of the drill pipes.

30. A drill pipe as claimed in claim 11, wherein one of the pair of stop collars is the first coupling.

* * * * *